US008991188B2

(12) United States Patent
Bailey et al.

(10) Patent No.: US 8,991,188 B2
(45) Date of Patent: Mar. 31, 2015

(54) FUEL NOZZLE PASSIVE PURGE CAP FLOW

(75) Inventors: Donald Mark Bailey, Simpsonville, SC (US); Robert Rohrssen, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1043 days.

(21) Appl. No.: 12/985,010

(22) Filed: Jan. 5, 2011

(65) Prior Publication Data

US 2012/0167586 A1 Jul. 5, 2012

(51) Int. Cl.

| | |
|---|---|
| ***F02C 1/00*** | (2006.01) |
| ***F02G 3/00*** | (2006.01) |
| ***F23R 3/28*** | (2006.01) |

(52) U.S. Cl.

CPC ..... *F23R 3/283* (2013.01); *F23R 3/286* (2013.01)

USPC ..... 60/740; 60/776; 60/737; 60/742

(58) Field of Classification Search

USPC ..... 60/737–748, 776

See application file for complete search history.

(56) References Cited

U.S. PATENT DOCUMENTS

| | | | |
|---|---|---|---|
| 3,948,043 | A | 4/1976 | Martz |
| 4,362,022 | A | 12/1982 | Faucher et al. |
| 4,365,470 | A | 12/1982 | Matthews et al. |
| 4,380,960 | A | 4/1983 | Dickinson |
| 4,488,866 | A | 12/1984 | Schirmer et al. |
| 5,161,363 | A | 11/1992 | Klaass et al. |
| 5,288,021 | A | 2/1994 | Sood et al. |
| 5,369,951 | A | 12/1994 | Corbett et al. |
| 5,408,830 | A | 4/1995 | Lovett |
| 5,540,045 | A | 7/1996 | Corbett et al. |
| 5,720,164 | A | 2/1998 | Corbett et al. |
| 6,145,294 | A | 11/2000 | Traver et al. |
| 6,216,439 | B1 | 4/2001 | Nakamoto |
| 6,244,034 | B1 | 6/2001 | Taylor et al. |
| 6,250,065 | B1 | 6/2001 | Mandai et al. |
| 6,385,961 | B2 | 5/2002 | Nakamoto |
| 6,385,975 | B1 | 5/2002 | Nakamoto |
| 6,389,795 | B1 | 5/2002 | Nakamoto |
| 6,393,827 | B1 | 5/2002 | Nakamoto |
| 6,609,380 | B2 | 8/2003 | Mick et al. |

(Continued)

FOREIGN PATENT DOCUMENTS

| | | |
|---|---|---|
| EP | 0 559 685 | 3/1997 |
| EP | 0 952 317 | 10/1999 |

(Continued)

OTHER PUBLICATIONS

Chinese Office Action dated Dec. 15, 2014 issued in Chinese Patent Application No. 201210022665.3 and English translation, 14 pp.

*Primary Examiner* — Craig Kim
(74) *Attorney, Agent, or Firm* — Nixon & Vanderhye P.C.

(57) ABSTRACT

A cooling circuit for a fuel nozzle in a gas turbine includes an end cap cavity receiving passive purge flow from a compressor of the turbine, and fuel nozzle swozzles disposed in a swozzle shroud that impart swirl to incoming fuel and air. Purge slots are formed in the swozzle shroud and through the fuel nozzle swozzles in fluid communication with the end cap cavity. The purge slots are positioned upstream of a quat fuel injection passage, and the passive purge flow enters fuel nozzle tip cavities of the fuel nozzle to provide tip cooling and tip purge volume without mixing the passive purge flow with quat fuel.

13 Claims, 6 Drawing Sheets

(56) References Cited

U.S. PATENT DOCUMENTS

| | | | | |
|---|---|---|---|---|
| 6,711,900 | B1 | 3/2004 | Patel et al. | |
| 6,722,132 | B2 | 4/2004 | Stuttaford et al. | |
| 6,786,245 | B1 | 9/2004 | Eichelberger et al. | |
| 6,892,544 | B2 | 5/2005 | Futa, Jr. et al. | |
| 6,915,636 | B2 | 7/2005 | Stuttaford et al. | |
| 6,923,002 | B2 | 8/2005 | Crawley et al. | |
| 7,104,070 | B2 | 9/2006 | Iasillo et al. | |
| 7,165,405 | B2 | 1/2007 | Stuttaford et al. | |
| 7,178,565 | B2 | 2/2007 | Eichelberger et al. | |
| 7,326,469 | B2 | 2/2008 | Dye et al. | |
| 8,281,596 | B1 * | 10/2012 | Rohrssen et al. | 60/747 |
| 2004/0159106 | A1 | 8/2004 | Patel et al. | |
| 2004/0261316 | A1 | 12/2004 | Weaver | |
| 2005/0144961 | A1 | 7/2005 | Colibaba-Evulet et al. | |
| 2006/0191268 | A1 | 8/2006 | Widener et al. | |
| 2007/0044477 | A1 | 3/2007 | Held et al. | |
| 2007/0048679 | A1 | 3/2007 | Joshi et al. | |
| 2007/0089425 | A1 | 4/2007 | Motter et al. | |
| 2009/0044538 | A1 | 2/2009 | Pelletier et al. | |
| 2009/0165436 | A1 | 7/2009 | Herbon et al. | |
| 2009/0223228 | A1 * | 9/2009 | Romoser | 60/776 |
| 2009/0255263 | A1 | 10/2009 | Doerr et al. | |
| 2009/0288421 | A1 | 11/2009 | Zeiner et al. | |
| 2010/0175380 | A1 * | 7/2010 | Davis et al. | 60/734 |

FOREIGN PATENT DOCUMENTS

| | | | |
|---|---|---|---|
| EP | 0 955 457 | | 11/1999 |
| EP | 0 667 492 | | 12/1999 |
| EP | 0 949 454 | | 3/2002 |
| EP | 1 184 621 | A1 | 3/2002 |
| EP | 1 199 442 | | 4/2002 |
| EP | 1 199 443 | | 4/2002 |
| EP | 1 199 453 | | 4/2002 |
| EP | 1 199 454 | | 4/2002 |
| EP | 1 398 572 | | 3/2004 |
| EP | 1 452 794 | | 9/2004 |
| EP | 1 510 760 | | 3/2005 |
| EP | 1 547 971 | | 6/2005 |
| EP | 1 696 178 | | 8/2006 |
| EP | 1 760 403 | | 3/2007 |
| EP | 1 870 581 | | 12/2007 |
| EP | 2 017 534 | | 1/2009 |
| EP | 2 018 917 | | 1/2009 |
| EP | 2 062 688 | | 5/2009 |
| EP | 2 065 643 | | 6/2009 |
| WO | WO 92/09791 | | 6/1992 |
| WO | WO 95/05561 | | 2/1995 |
| WO | WO 99/32770 | | 7/1999 |
| WO | WO 03/093666 | | 11/2003 |
| WO | WO 2004/070275 | | 8/2004 |
| WO | WO 2004/094568 | | 11/2004 |

* cited by examiner

FUEL NOZZLE PASSIVE PURGE CAP FLOW

BACKGROUND OF THE INVENTION

The invention relates generally to gas turbines and, more particularly, to a fuel nozzle for a gas turbine engine including a cooling circuit that utilizes passive purge flow for fuel nozzle tips supplied from end cap cooling flow before quat fuel injection.

Conventional quat fuel injection systems utilize CdC air mixed with quat fuel for passive purge feeds. The presence of fuel in the passive purge feed elevates a risk of flame holding in the passive purge cavities and within the fuel nozzle tips. It would be desirable to use the end cap purge feed that is free of quat fuel to provide an alternate means to purge the fuel nozzle tips and eliminate the flame holding risk from the design.

BRIEF DESCRIPTION OF THE INVENTION

In an exemplary embodiment, a cooling circuit for a fuel nozzle in a gas turbine includes an annulus receiving compressor discharge air, a quat cap including a fuel passage through which quat fuel is injected toward the fuel nozzle, and an air passage formed in the quat cap and receiving the compressor discharge air from the annulus. The air passage is positioned upstream of the fuel passage such that the compressor discharge air is not mixed with quat fuel. Purge passages in the fuel nozzle receive the compressor discharge air from the air passage. The purge passages direct the compressor discharge air to the fuel nozzle for tip cooling.

In another exemplary embodiment, a method of cooling a fuel nozzle in a gas turbine includes the steps of (a) receiving compressor discharge air in an annulus; b) directing the compressor discharge air from the annulus to an air passage formed in a quat cap, where the air passage is positioned upstream of a quat fuel passage such that the compressor discharge air in the air passage is not mixed with quat fuel; and (c) receiving the compressor discharge air from the air passage in purge passages in the fuel nozzle, the purge passages directing the compressor discharge air to the fuel nozzle for tip cooling.

In yet another exemplary embodiment, a cooling circuit for a fuel nozzle in a gas turbine includes an end cap cavity receiving passive purge flow from a compressor of the turbine, and fuel nozzle swozzles disposed in a swozzle shroud that impart swirl to incoming fuel and air. Purge slots are formed in the swozzle shroud and through the fuel nozzle swozzles in fluid communication with the end cap cavity. The purge slots are positioned upstream of a quat fuel injection passage, and the passive purge flow enters fuel nozzle tip cavities of the fuel nozzle to provide tip cooling and tip purge volume without mixing the passive purge flow with quat fuel.

DETAILED DESCRIPTION OF THE INVENTION

Figure 1:
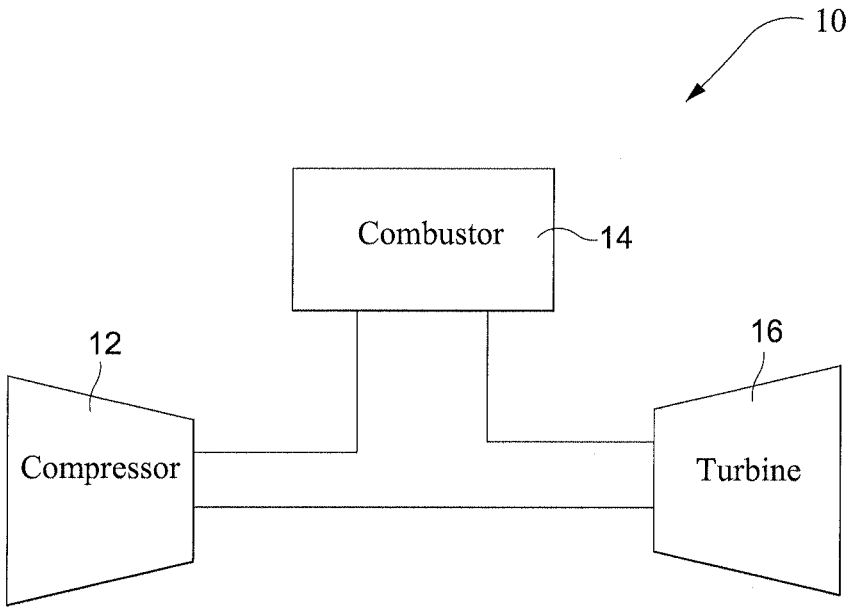
FIG. 1 is a simplified cross-section of a gas turbine.

FIG. 1 illustrates a typical gas turbine 10. As shown, the gas turbine 10 generally includes a compressor at the front, one or more combustors 14 around the middle, and a turbine 16 at the rear. The compressor 12 and the turbine 16 typically share a common rotor. The compressor 12 progressively compresses a working fluid and discharges the compressed working fluid to the combustors 14. The combustors 14 inject fuel into the flow of compressed working fluid and ignite the mixture to produce combustion gases having a high temperature, pressure and velocity. The combustion gases exit the combustors 14 and flow to the turbine 16 where they expand to produce work.

A casing surrounds each combustor 14 to contain the compressed working fluid from the compressor 12. Nozzles are arranged in an end cover, for example, with outer nozzles radially arranged around a center nozzle. The compressed working fluid from the compressor 12 flows between the casing and a liner to the outer and center nozzles, which mix fuel with the compressed working fluid, and the mixture flows from the outer and center nozzles into upstream and downstream chambers where combustion occurs.

As noted, prior designs have used quat mixed CdC air to feed passive purge for fuel nozzle tips. The presence of fuel in the passive purge feed, however, elevates a risk of flame holding in the passive purge cavities and within the fuel nozzle tips. With reference to FIGS. 2-6, the described embodiments utilize end cap purge feed that is free of quat fuel as an alternate means to purge the fuel nozzle tips. With the purge feed being free of quat fuel, a flame holding risk is eliminated from the design.

Figure 2:
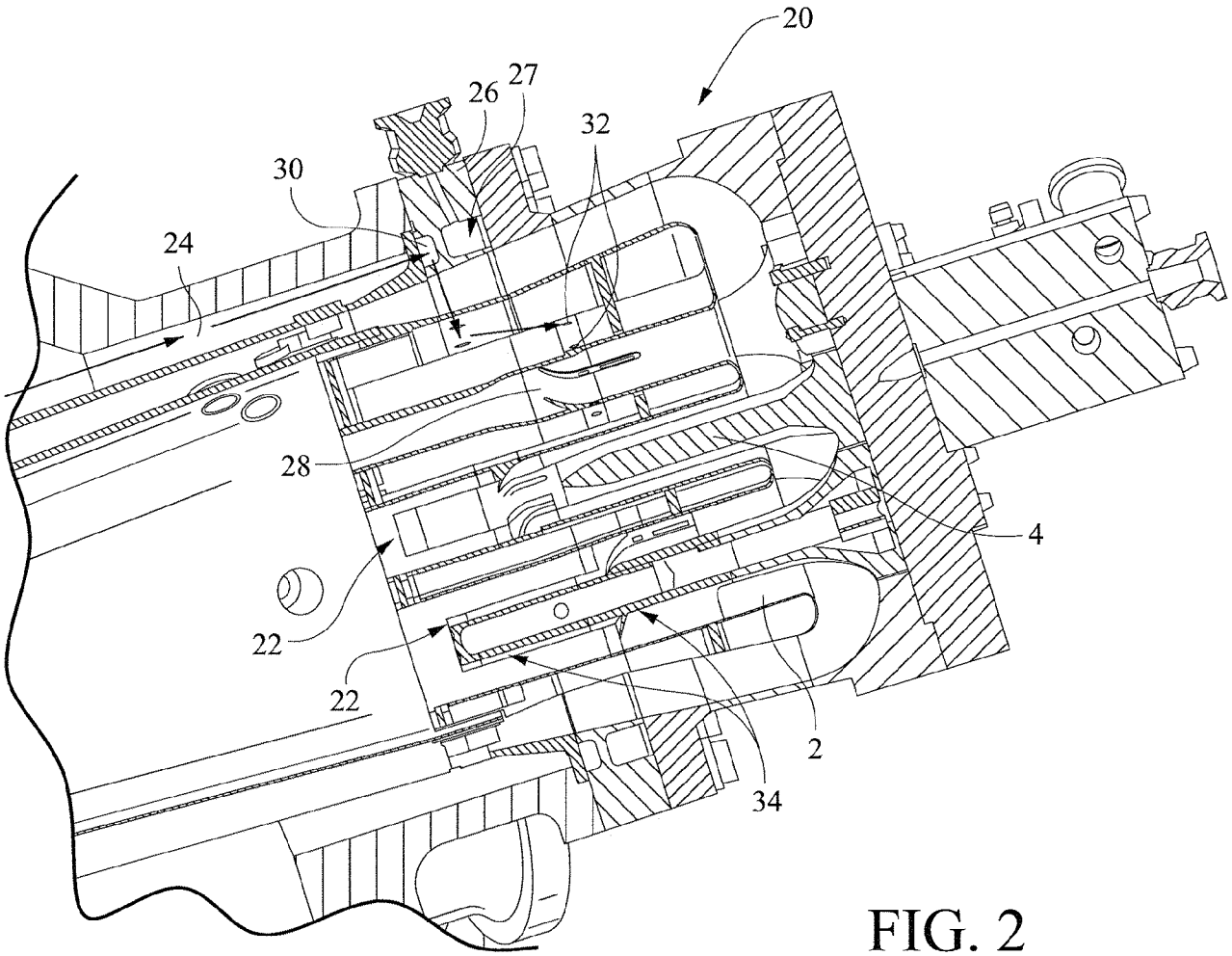
FIG. 2 is a sectional view showing the fuel nozzles of the combustor.

FIG. 2 is a cross-sectional view showing the outer and center fuel nozzles. The assembly includes a cooling circuit 20. In use, parts of the nozzle including a nozzle tip end 22 must be cooled due to their exposure to hot combustion gas. The combustor includes an annulus 24 that receives compressor discharge air from the compressor. A quat cap 26 includes a fuel passage 27 through which quat fuel is injected toward the fuel nozzles. The quat fuel is injected into a swozzle assembly 28, including a fuel nozzle swozzle disposed in a swozzle shroud. The swozzle assembly 28 imparts swirl to the incoming fuel and air.

The cooling circuit 20 includes an air passage 30 formed in the quat cap 26 that receives the compressor discharge air from the annulus 24. As shown in FIG. 2, the air passage 30 is positioned upstream of the fuel passage 27. As a consequence, the compressor discharge air in the air passage 30 is not mixed with quat fuel. Purge passages 32 in the fuel nozzle receive the compressor discharge air via the air passage 30. The purge passages 32 direct the compressor discharge air to the fuel nozzle for tip cooling.

As shown, the purge passages 32 are formed in the swozzle assembly 28. Preferably, the purge passages 32 comprise slots formed in the swozzle 28.

Figure 3:
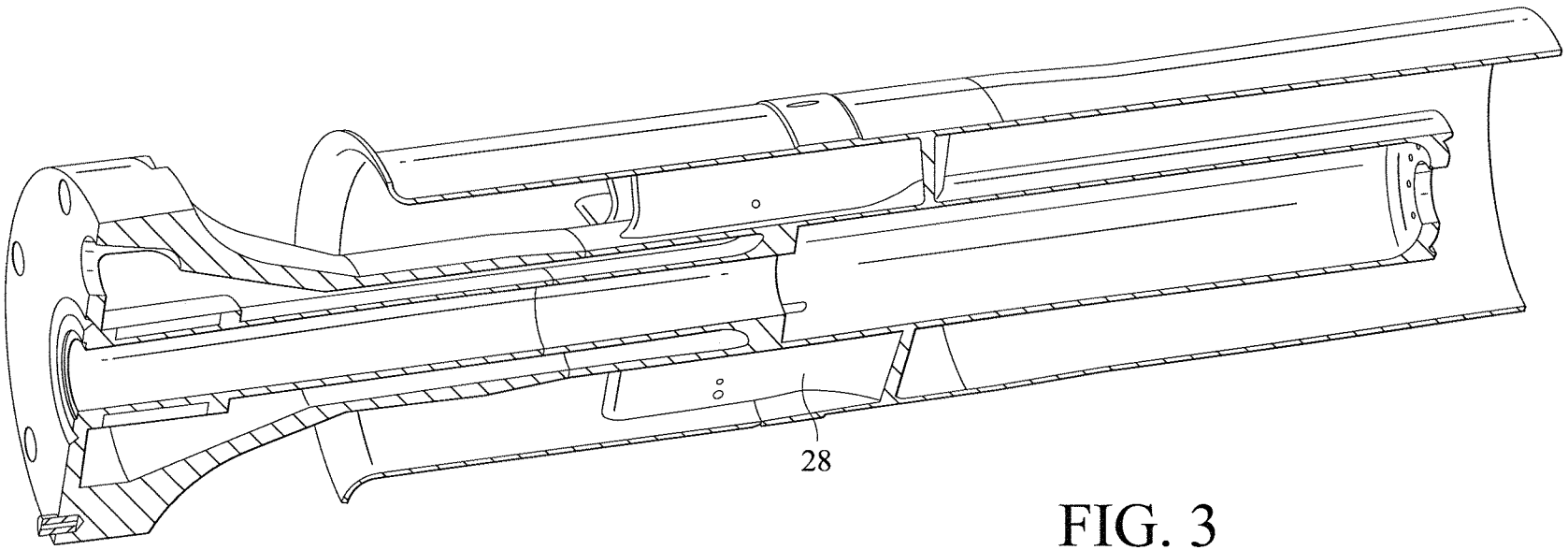
FIGS. 3 and 4 are sectional views of an outer fuel nozzle.
Figure 4:
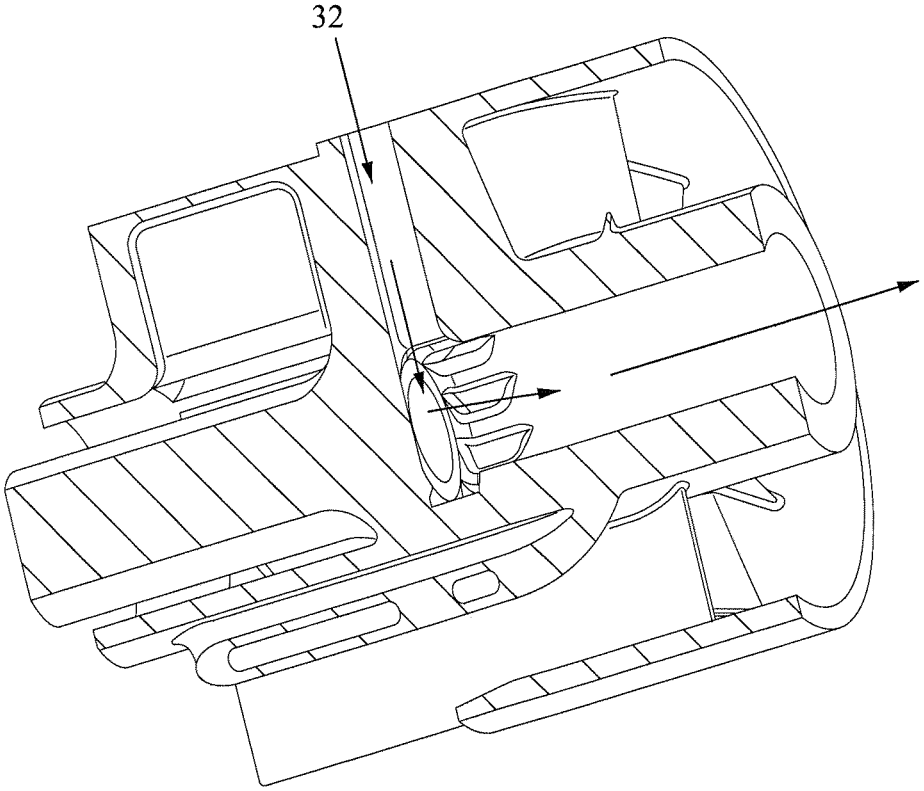
Figure 5:
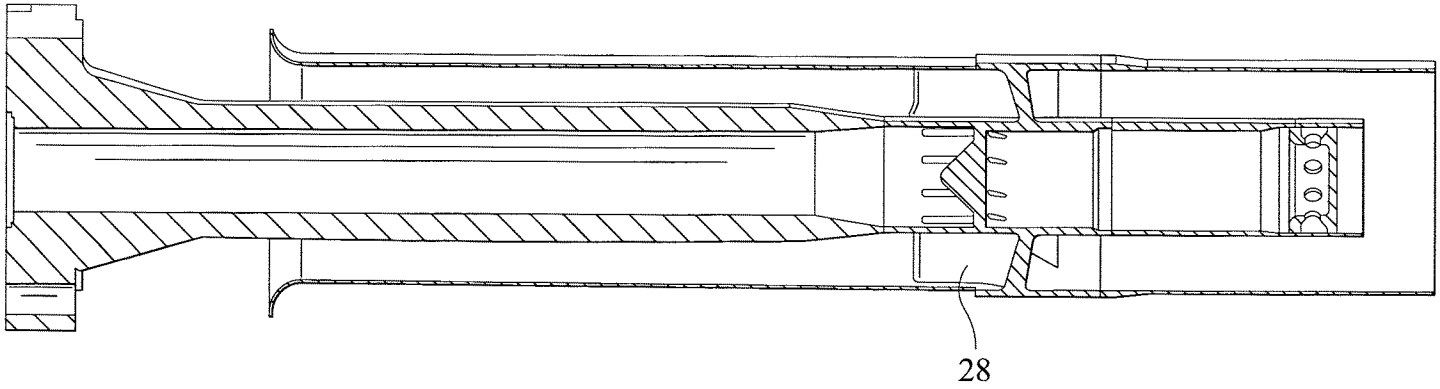
FIGS. 5 and 6 are sectional views of a center fuel nozzle.
Figure 6:
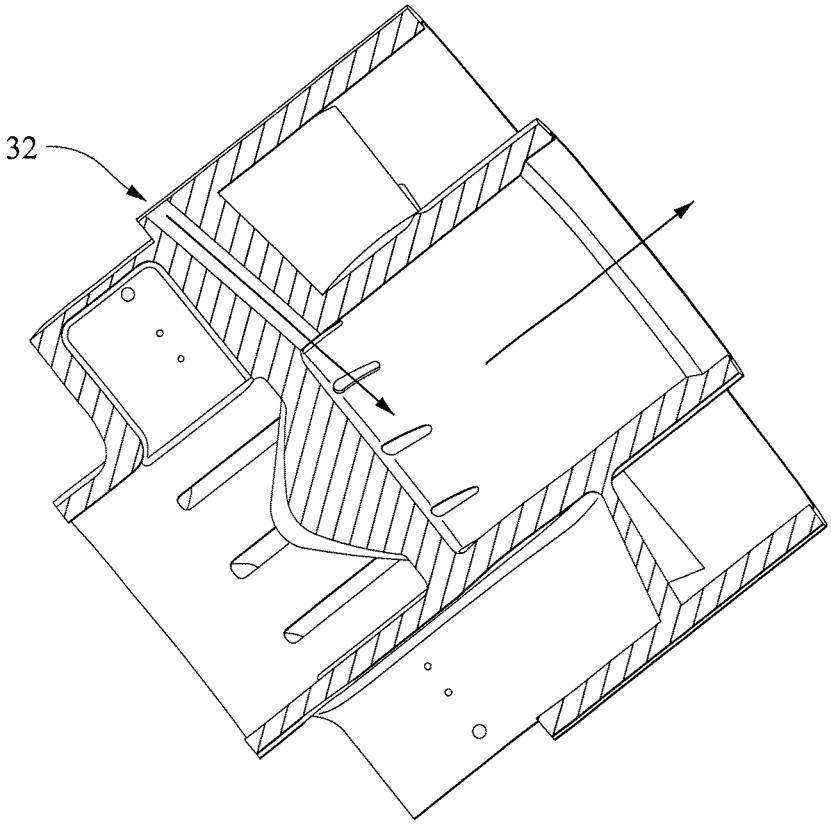

In a typical construction, the combustor includes several outer nozzles circumferentially surrounding a center nozzle. FIG. 2 is a sectional view through one of the outer fuel nozzles 2 and showing a relative position of the center fuel nozzle 4. FIGS. 3 and 4 are sectional views through an outer fuel nozzle, and FIGS. 5 and 6 are sectional views through the center fuel nozzle. As shown, the purge passages 32 are formed in the swozzle 28.

With continued reference to FIG. 2, a nozzle tip cooling passage 34 surrounds the fuel nozzle, and a portion of the pressure discharge air from the air passage 30 is directed to the nozzle tip cooling passage 34 for cooling the nozzle tip.

The flow path of the compressor discharge air is shown by arrows in FIGS. 2, 4 and 6. The compressor discharge air is received in the annulus 24 and is directed to the air passage 30 formed in the quat cap 26. As noted previously, since the air passage 30 is positioned upstream of the quat fuel passage 28, the compressor discharge air in the air passage 30 is not mixed with quat fuel. From the air passage 30, the compressor discharge air is received in purge passages or slots 32 in the fuel nozzle. The purge passages 32 direct the compressor discharge air to the fuel nozzle for tip cooling. Additionally, a portion of the compressor discharge air from the air passage 30 is directed to the nozzle tip cooling passage 34 for cooling the blank cartridge and/or liquid cartridge tips housed inside the outer fuel nozzles.

With the described embodiments, the fuel nozzle swozzles have purge slots on the outside of the swozzle shroud to allow passive purge cooling air from the end cap cavity to enter into the fuel nozzle tip cavities and provide tip cooling and tip purge volume. The cap feed air is before quat injection, thereby reducing or eliminating the risk of a flame holding event caused by passive purge air mixed with fuel in prior designs.

The added purge slots eliminate the need to provide purge air from the end cover side of the combustion chamber for cooling, this air typically has been mixed with fuel. Additionally, the purge slots simplify the design, eliminating a need to take a feeder pipe in the compressor discharge circuits and feed each end cover on the back end, which would require additional circuitry to direct air to the nozzles. The design still further reduces the fuel nozzle complexity by simplifying the number of fluid circuits required at the flange interface allowing for improved durability and lower cost.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A cooling circuit for a fuel nozzle in a gas turbine, comprising:

an annulus receiving compressor discharge air;

a quat cap including a fuel passage through which quat fuel is injected toward the fuel nozzle;

an air passage formed in the quat cap and receiving the compressor discharge air from the annulus, wherein the air passage is positioned upstream of and is separate from the fuel passage such that the compressor discharge air is not mixed with quat fuel; and purge passages in the fuel nozzle receiving the compressor discharge air from the air passage, wherein the purge passages are configured to direct the compressor discharge air to the fuel nozzle for tip cooling.

2. A cooling circuit according to claim 1, wherein the fuel nozzle comprises a swozzle that imparts swirl to incoming fuel and air, and wherein the purge passages are formed in the swozzle.

3. A cooling circuit according to claim 2, wherein the purge passages comprise slots formed in the swozzle.

4. A cooling circuit according to claim 1, wherein the fuel nozzle is a center fuel nozzle.

5. A cooling circuit according to claim 1, wherein the gas turbine includes a plurality of outer fuel nozzles surrounding a center fuel nozzle, and wherein the cooling circuit directs the compressor discharge air to the outer fuel nozzles and the center fuel nozzle.

6. A cooling circuit according to claim 1, further comprising a nozzle tip cooling passage surrounding the fuel nozzle, wherein a portion of the compressor discharge air from the air passage is directed to the nozzle tip cooling passage for cooling the nozzle tip.

7. A cooling circuit according to claim 1, wherein the purge passages comprise slots formed in the fuel nozzle.

8. A method of cooling a fuel nozzle in a gas turbine, the method comprising:

(a) receiving compressor discharge air in an annulus;

(b) directing the compressor discharge air from the annulus to an air passage formed in a quat cap, wherein the air passage is positioned upstream of and is separate from a quat fuel passage such that the compressor discharge air in the air passage is not mixed with quat fuel; and (c) receiving the compressor discharge air from the air passage in purge passages in the fuel nozzle, the purge passages directing the compressor discharge air to the fuel nozzle for tip cooling.

9. A method according to claim 8, wherein the fuel nozzle comprises a swozzle that imparts swirl to incoming fuel and air, and wherein the method comprises forming the purge passages in the swozzle.

10. A method according to claim 8, wherein the fuel nozzle further comprises a nozzle tip cooling passage surrounding the fuel nozzle, wherein the method comprises directing a portion of the compressor discharge air from the air passage to the nozzle tip cooling passage for cooling the nozzle tip.

11. A cooling circuit for a fuel nozzle in a gas turbine, comprising:

an end cap cavity receiving passive purge flow from a compressor of the turbine;

fuel nozzle swozzles disposed in a swozzle shroud that impart swirl to incoming fuel and air; and purge slots formed in the swozzle shroud and through the fuel nozzle swozzles in fluid communication with the end cap cavity, wherein the purge slots are positioned upstream of and are separate from a quat fuel injection passage, and wherein the passive purge flow enters fuel nozzle tip cavities of the fuel nozzle to provide tip cooling and tip purge volume without mixing the passive purge flow with quat fuel.

12. A cooling circuit according to claim 11, wherein the fuel nozzle is a center fuel nozzle.

13. A cooling circuit according to claim 11, wherein the gas turbine includes a plurality of outer fuel nozzles surrounding a center fuel nozzle, and wherein the cooling circuit directs the passive purge flow to the outer fuel nozzles and the center fuel nozzle.

* * * * *